US010745788B2

(12) United States Patent
Hasan et al.

(10) Patent No.: US 10,745,788 B2
(45) Date of Patent: Aug. 18, 2020

(54) HIGH-THROUGHPUT FABRICATION OF PATTERNED SURFACES AND NANOSTRUCTURES BY HOT-PULLING OF METALLIC GLASS ARRAYS

(71) Applicant: Texas Tech University System, Lubbock, TX (US)

(72) Inventors: Molla Hasan, Lubbock, TX (US); Golden Kumar, Lubbock, TX (US)

(73) Assignee: Texas Tech University System, Lubbock, TX (US)

( * ) Notice: Subject to any disclaimer, the term of this patent is extended or adjusted under 35 U.S.C. 154(b) by 395 days.

(21) Appl. No.: 15/591,841

(22) Filed: May 10, 2017

(65) Prior Publication Data

US 2017/0327935 A1 Nov. 16, 2017

Related U.S. Application Data

(60) Provisional application No. 62/333,901, filed on May 10, 2016.

(51) Int. Cl.

| | |
|---|---|
| ***C22F 1/14*** | (2006.01) |
| ***C22F 1/18*** | (2006.01) |
| ***C22F 1/10*** | (2006.01) |
| ***C22F 1/00*** | (2006.01) |
| ***C22C 45/10*** | (2006.01) |
| ***C22C 45/04*** | (2006.01) |
| ***C22C 45/00*** | (2006.01) |
| ***B22D 21/00*** | (2006.01) |
| ***B22D 25/02*** | (2006.01) |
| ***B22F 1/00*** | (2006.01) |
| *C22C 1/04* | (2006.01) |

(52) U.S. Cl.

CPC ..... *C22F 1/186* (2013.01); *B22D 21/005* (2013.01); *B22D 25/02* (2013.01); *B22F 1/0018* (2013.01); *B22F 1/0025* (2013.01); *B22F 1/0044* (2013.01); *C22C 45/003* (2013.01); *C22C 45/04* (2013.01); *C22C 45/10* (2013.01); *C22F 1/002* (2013.01); *C22F 1/10* (2013.01); *C22F 1/14* (2013.01); *B22F 2001/0029* (2013.01); *B22F 2999/00* (2013.01); *C22C 1/0433* (2013.01); *C22C 1/0458* (2013.01); *C22C 1/0466* (2013.01); *C22C 2200/02* (2013.01); *C22C 2200/04* (2013.01)

(58) Field of Classification Search

None

See application file for complete search history.

(56) References Cited

U.S. PATENT DOCUMENTS

| | | | |
|---|---|---|---|
| 7,597,814 | B2 | 10/2009 | Stasiak et al. |
| 7,627,938 | B2 | 12/2009 | Kim et al. |
| 8,236,368 | B2 | 8/2012 | Jung et al. |

(Continued)

FOREIGN PATENT DOCUMENTS

| | | | |
|---|---|---|---|
| WO | 2008096335 | A2 | 8/2008 |

*Primary Examiner* — George Wyszomierski

(74) *Attorney, Agent, or Firm* — Edwin S. Flores; Daniel J. Chalker; Chalker Flores, LLP

(57) ABSTRACT

The present invention includes composition and methods for the fabrication of very-high-aspect-ratio structures from metallic glasses. The present invention provides a method for nondestructive demolding of templates after thermoplastic molding of metallic glass features.

13 Claims, 10 Drawing Sheets

(56) References Cited

U.S. PATENT DOCUMENTS

| | | | | |
|---|---|---|---|---|
| 2007/0237959 | A1* | 10/2007 | Lemaire | B82Y 30/00 428/408 |
| 2009/0045720 | A1 | 2/2009 | Lee et al. | |
| 2010/0098967 | A1* | 4/2010 | Schroers | C22C 45/00 428/600 |
| 2010/0303722 | A1* | 12/2010 | Jin | A61L 27/30 424/9.1 |
| 2015/0183188 | A1* | 7/2015 | Richards | B82Y 10/00 428/624 |

* cited by examiner

Nano-tips on MG surface

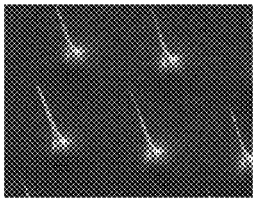
FIGURE 4A
Nano-rods on metallic glass surface
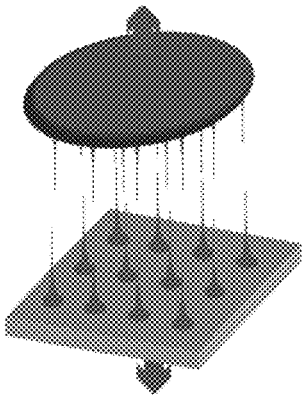
FIGURE 4B
FIGURE 4C
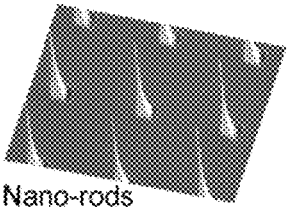
FIGURE 4D
Nano-rods Nano-tubes on metallic glass surface Nano-wires on metallic glass surface Complete demolding of metallic glass micro pattern Pd-based metallic glass on Si Zr-based metallic glass on Si Ni-based metallic glass on Si

HIGH-THROUGHPUT FABRICATION OF PATTERNED SURFACES AND NANOSTRUCTURES BY HOT-PULLING OF METALLIC GLASS ARRAYS

CROSS-REFERENCE TO RELATED APPLICATIONS

This application claims priority to U.S. Provisional Application Ser. No. 62/333,901, filed May 10, 2016, the entire contents of which are incorporated herein by reference.

TECHNICAL FIELD OF THE INVENTION

The present invention relates generally to methods and compositions for fabrication of patterned surfaces and nanostructures by hot-pulling of metallic glass.

STATEMENT OF FEDERALLY FUNDED RESEARCH

None.

INCORPORATION-BY-REFERENCE OF MATERIALS FILED ON COMPACT DISC

None.

BACKGROUND OF THE INVENTION

Without limiting the scope of the invention, its background is described in connection with hot-pulling of metallic glass to form patterned surfaces and nanostructures.

U.S. Pat. No. 8,236,368, entitled, "Method for preparing a hollow microneedle" discloses a method for preparing a hollow microneedle by preparing a solid microneedle by drawing lithography; plating the surface with a metal; removing the solid microneedle; and fabricating the hollow microneedle. The present invention ensures efficient preparation of a hollow microneedle with desired hardness, length, and diameter, and which may be effectively used for extracting internal analytical materials from the body and for drug injection.

U.S. Pat. No. 7,627,938, entitled, "Tapered hollow metallic microneedle array assembly and method of making and using the same," describes devices, systems, method of using and making a microneedle array including the steps of forming one or more pins on a substrate, depositing one or more layers on the one or more pins and the substrate, exposing a portion of the one or more pins, and separating the one or more pins from the one or more layers to form the hollow microneedle array.

U.S. Pat. No. 7,597,814, entitled, "Structure formed with template having nano-scale features," describes a method of fabricating ordered patterns of nano-scale objects on a substrate surface.

U.S. Patent Application Publication No. 2009/0045720, entitled, "Method for producing nanowires using porous glass template, and multi-probe, field emission tip and devices employing the nanowires," describes a method for producing nanowires, which features the use of a porous glass template in combination with a solid-liquid-solid or vapor-liquid-solid process for growing nanowires which are highly straight and have nanoparticles precisely arranged therein.

PCT Patent Application Publication No. WO2008/096335, entitled, "Producing an array of nano-scale structures on a substrate surface via a self-assembled template," describes a method for producing an array of nano-scale structures on a substrate surface, via a self-assembled template.

SUMMARY OF THE INVENTION

The present invention provides a method for creating hundreds to thousands of metallic glass nano-features simultaneously for any aspect-ratio using inexpensive micro-templates to provide high surface area in integrated circuit design. The present invention provides a method for the fabrication of very-high-aspect-ratio structures from metallic glasses. The present invention provides a method for nondestructive demolding of templates after thermoplastic molding of metallic glass features. Prior to the present invention it has been challenging because of high molding pressure required to fill long cavities in templates; the templates used for molding of nano-scale metallic glasses are expensive and disposable; and the fabrication of patterned surfaces and free nanostructures require two different processing steps.

The present invention provides a method of preparing metallic glass nano-structures comprising the steps of: providing a metallic glass composition on a first surface; heating the metallic glass composition to a temperature; contacting a template surface to the metallic glass composition; applying a strain by moving the template surface away from the metallic glass composition to form nano-structures on the template surface and on the first surface; and annealing the nano-structures to form crystallized metallic glass nano-structures. The method may include the step of adjusting the strain and the temperature, or both. The nano-structures may include metallic glass nano-tips, metallic glass nano-rods, metallic glass nano-tubes, metallic glass nano-needles, metallic glass nano-wires, metallic glass nano-features, metallic glass micro-features or combinations thereof. The aspect-ratio of the nano-structures may include greater than 800 or 1000, e.g., 800, 825, 850, 875, 900, 925, 950, 975, 1000, 1025, 1050, 1075, 1100, 1125, 1150, 1175, 1200, 1225, 1250, 1275, 1300, 1325, 1350, 1375, 1400, 1425, 1450, 1475, 1500, 1550, 1600, 1650, 1700, 1800, 1900, 2000, 2100, 2200, 2300, 2400, 2500, 2600, 2700, 2800, 2900, 3000, 3500, 4000, 4500, 5000, 5500, 6000, 6500, 7000, 8000, 9000, 10000 or incremental variations thereof. The template surface or both may include silicon, quartz, metal, and polymer. The metallic glass composition may include Pt, Pd, Ni, Zn or a combination thereof, e.g., $Pt_{57.5}Cu_{14.7}Ni_{5.3}P_{22.5}$; $Pd_{43}Cu_{27}Ni_{10}P_{20}$; $Ni_{60}Pd_{20}P_{17}B_3$; $Zr_{35}Ti_{30}Cu_{8.25}Be_{26.75}$; $Zr_{51}Ti_9Cu_{15}Be_{25}$; $Zr_{54}Ti_{11}Cu_{12.5}Be_{22.5}$; $Zr_{41.2}Ti_{13.8}Ni_{10}Cu_{12.5}Be_{22.5}$; $Zr_{46.75}Ti_{8.25}Ni_{10}Cu_{7.5}Be_{27.5}$; $Pd_{43}Ni_{10}Cu_{27}P_{20}$; $Pt_{60}Ni_{15}P_{25}$; $Ce_{68}Cu_{20}Al_{10}Nb_2$; $Au_{49}Ag_{5.5}Pd_{2.3}Cu_{26.9}Si_{16.3}$; $Zr_{36.6}Ti_{31.4}Nb_7Cu_{5.9}Be_{19.1}$; $Ti_{48}Zr_{20}V_{12}Cu_5Be_{15}$ or a combination thereof.

The present invention provides a method of preparing metallic glass nano-structures comprising the steps of: providing a metallic glass composition on a first surface; heating the metallic glass composition to a temperature to form an amorphous metallic glass composition; contacting a template surface to the amorphous metallic glass composition; applying a strain by moving the template surface away from the amorphous metallic glass composition to form amorphous nano-structures on the template surface and on the first surface; and annealing the amorphous nano-structures to form crystallized metallic glass nano-structures. The method may include the step of adjusting the strain and the temperature, or both. The nano-structures may include metallic glass nano-tips, metallic glass nano-rods, metallic glass nano-tubes, metallic glass nano-needles, metallic glass nano-wires, metallic glass nano-features, metallic glass micro-features or combinations thereof. The aspect-ratio of the nano-structures may include greater than 800 or 1000, e.g., 800, 825, 850, 875, 900, 925, 950, 975, 1000, 1025, 1050, 1075, 1100, 1125, 1150, 1175, 1200, 1225, 1250, 1275, 1300, 1325, 1350, 1375, 1400, 1425, 1450, 1475, 1500, 1550, 1600, 1650, 1700, 1800, 1900, 2000, 2100, 2200, 2300, 2400, 2500, 2600, 2700, 2800, 2900, 3000, 3500, 4000, 4500, 5000, 5500, 6000, 6500, 7000, 8000, 9000, 10000 or incremental variations thereof. The template surface or both may include silicon, quartz, metal, and polymer. The metallic glass composition may include Pt, Pd, Ni, Zn or a combination thereof, e.g., $Pt_{57.5}Cu_{14.7}Ni_{5.3}P_{22.5}$; $Pd_{43}Cu_{27}Ni_{10}P_{20}$; $Ni_{60}Pd_{20}P_{17}B_3$; $Zr_{35}Ti_{30}Cu_{8.25}Be_{26.75}$; $Zr_{51}Ti_9Cu_{15}Be_{25}$; $Zr_{54}Ti_{11}Cu_{12.5}Be_{22.5}$; $Zr_{41.2}Ti_{13.8}Ni_{10}Cu_{12.5}Be_{22.5}$; $Zr_{46.75}Ti_{8.25}Ni_{10}Cu_{7.5}Be_{27.5}$; $Pd_{43}Ni_{10}Cu_{27}P_{20}$; $Pt_{60}Ni_{15}P_{25}$; $Ce_{68}Cu_{20}Al_{10}Nb_2$; $Au_{49}Ag_{5.5}Pd_{2.3}Cu_{26.9}Si_{16.3}$; $Zr_{36.6}Ti_{31.4}Nb_7Cu_{5.9}Be_{19.1}$; $Ti_{48}Zr_{20}V_{12}Cu_5Be_{15}$ or a combination thereof.

The present invention provides method of preparing a metallic glass hollow nano-needle comprising the steps of: providing a metallic glass composition on a first surface; heating the metallic glass composition to a temperature to form an amorphous metallic glass composition; contacting a template surface to the amorphous metallic glass composition; applying a strain by moving the template surface away from the amorphous metallic glass composition to form an amorphous metallic glass hollow nano-needle on the template surface and on the first surface; and annealing the amorphous metallic glass hollow nano-needle to form a crystallized metallic glass hollow nano-needle.

The method may include the step of adjusting the strain and the temperature, or both. The nano-structures may include metallic glass nano-tips, metallic glass nano-rods, metallic glass nano-tubes, metallic glass nano-needles, metallic glass nano-wires, metallic glass nano-features, metallic glass micro-features or combinations thereof. The aspect-ratio of the nano-structures may include greater than 800 or 1000, e.g., 800, 825, 850, 875, 900, 925, 950, 975, 1000, 1025, 1050, 1075, 1100, 1125, 1150, 1175, 1200, 1225, 1250, 1275, 1300, 1325, 1350, 1375, 1400, 1425, 1450, 1475, 1500, 1550, 1600, 1650, 1700, 1800, 1900, 2000, 2100, 2200, 2300, 2400, 2500, 2600, 2700, 2800, 2900, 3000, 3500, 4000, 4500, 5000, 5500, 6000, 6500, 7000, 8000, 9000, 10000 or incremental variations thereof. The template surface or both may include silicon, quartz, metal, and polymer. The metallic glass composition may include Pt, Pd, Ni, Zn or a combination thereof, e.g., $Pt_{57.5}Cu_{14.7}Ni_{5.3}P_{22.5}$; $Pd_{43}Cu_{27}Ni_{10}P_{20}$; $Ni_{60}Pd_{20}P_{17}B_3$; $Zr_{35}Ti_{30}Cu_{8.25}Be_{26.75}$; $Zr_{51}Ti_9Cu_{15}Be_{25}$; $Zr_{54}Ti_{11}Cu_{12.5}Be_{22.5}$; $Zr_{41.2}Ti_{13.8}Ni_{10}Cu_{12.5}Be_{22.5}$; $Zr_{46.75}Ti_{8.25}Ni_{10}Cu_{7.5}Be_{27.5}$; $Pd_{43}Ni_{10}Cu_{27}P_{20}$; $Pt_{60}Ni_{15}P_{25}$; $Ce_{68}Cu_{20}Al_{10}Nb_2$; $Au_{49}Ag_{5.5}Pd_{2.3}Cu_{26.9}Si_{16.3}$; $Zr_{36.6}Ti_{31.4}Nb_7Cu_{5.9}Be_{19.1}$; $Ti_{48}Zr_{20}V_{12}Cu_5Be_{15}$ or a combination thereof.

The present invention provides a crystallized metallic glass nano-structures comprising: a crystallized metallic glass nano-structure extending from a substrate, wherein the crystallized metallic glass nano-structures has an aspect ratio greater than 1000 and comprises $Pt_{57.5}Cu_{14.7}Ni_{5.3}P_{22.5}$; $Pd_{43}Cu_{27}Ni_{10}P_{20}$; $Ni_{60}Pd_{20}P_{17}B_3$; $Zr_{35}Ti_{30}Cu_{8.25}Be_{26.75}$; $Zr_{51}Ti_9Cu_{15}Be_{25}$; $Zr_{54}Ti_{11}Cu_{12.5}Be_{22.5}$; $Zr_{41.2}Ti_{13.8}Ni_{10}Cu_{12.5}Be_{22.5}$; $Zr_{46.75}Ti_{8.25}Ni_{10}Cu_{7.5}Be_{27.5}$; $Pd_{43}Ni_{10}Cu_{27}P_{20}$; $Pt_{60}Ni_{15}P_{25}$; $Ce_{68}Cu_{20}Al_{10}Nb_2$; $Au_{49}Ag_{5.5}Pd_{2.3}Cu_{26.9}Si_{16.3}$; $Zr_{36.6}Ti_{31.4}Nb_7Cu_{5.9}Be_{19.1}$; $Ti_{48}Zr_{20}V_{12}Cu_5Be_{15}$ or a combination thereof.

BRIEF DESCRIPTION OF THE DRAWINGS

For a more complete understanding of the features and advantages of the present invention, reference is now made to the detailed description of the invention along with the accompanying figures and in which:

FIGS. 4A-4D show the hot metallic glass composition being hot pulled from the micro-template by adjusting the temperature, the strain rate, and the strain to form metallic glass nano-rods both on template and metallic glass surface.

DETAILED DESCRIPTION OF THE INVENTION

Figure 1A:
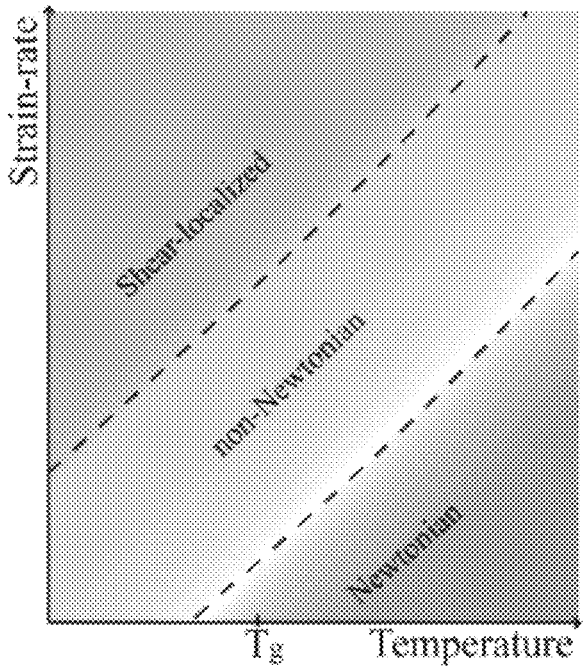
FIGS. 1A and 1B are schematic illustrations of different elongation of metallic glass supercooled liquid in different flow regimes.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Steps or procedures, sub-steps or sub-procedures, equipment, reagents, and materials, as well as operation and implementation, of exemplary preferred embodiments, alternative preferred embodiments, specific configurations, and, additional and optional aspects, characteristics, or features, thereof, of the method for producing (fabricating) an array of nanoscale structures on a substrate surface, according to the present invention, are better understood with reference to the following illustrative description and accompanying drawings.

As used herein, the term 'feature' and/or 'features', as used herein, refers to distinct, distinguishing, or characterizing, parts (e.g., structures, sub-structures, elements, sub-elements) of an object or entity. Accordingly, the term 'features', as used herein, refers to, for example, distinct, distinguishing, or characterizing, parts (e.g., structures, sub-structures, elements, sub-elements) of a surface. Herein, exemplary features, i.e., distinct, distinguishing, or characterizing, parts (e.g., structures, sub-structures, elements, sub-elements), of a surface of a self-assembled template, are: facets, grooves, tips, rods, tubes, wires, and steps. Herein, these exemplary features are indicated as being of 'nanoscale', i.e., nanofacets, nanogrooves, nano-tips, nanorods, nano-tubes, nano-wires, and nanosteps, respectively, where the term 'nano', other terms prefixed by the term 'nano', and phrases including 'nano' terms, are each defined immediately following.

As used herein, the term 'nano', as used herein, refers to the prefix (symbol 'n') of the unit, meter (symbol 'm') in the SI (International System of Units) system of units denoting a factor of $10^{-9}$, of a size dimension (e.g., length, width, height (thickness), depth, diameter, pitch), expressed in terms of nanometer or nanometers, each abbreviated or symbolized as 'nm'. The term 'nano' is also used herein as a prefix of, and combined with, each of various other terms, for indicating that the 'other' term, i.e., feature(s), structure(s), element(s), or characteristic(s), has (have), or is (are) associated with, at least one size dimension (e.g., length, width, height (thickness), depth, diameter, pitch) in the range of between about one (1) nanometer (nm) and about one-thousand (1000) nanometers (nm) [one (1) micron].

As used herein, the term 'nano' is used as a prefix of, and combined with, each of the following terms (expressed in singular form, or in plural form, i.e., with the suffix 's' (s)): facet(s), groove(s), grooved, step(s), stepped, wire(s), strip(s), particle(s), belt(s), pattern(s), and scale. Accordingly, the following 'nano' terms (expressed in singular form, or in plural form, i.e., with the suffix 's' (s)) are used herein: nanofacet(s), nanogroove(s), nanogrooved, nanostep(s), nanostepped, nanotip(s), nanotube(s), nanorod(s), nanowire(s), nanostrip(s), nanoparticle(s), nanobelt(s), nanopattern(s), and nanoscale. Thus, herein, each of the following 'nano' terms: nanofacet(s), nanogroove(s), nanostep(s), nanowire(s), nanostrip(s), nanoparticle(s), nanobelt(s), and nanopattern(s), is used for indicating that the feature(s), structure(s), element(s), or characteristic(s)), i.e., facet(s), groove(s), step(s), wire(s), tip(s), rod(s), tube(s), wire(s), strip(s), particle(s), belt(s), or pattern(s), respectively, has (have), or is associated with, at least one size dimension (e.g., length, width, height (thickness), depth, diameter, pitch), whose value or magnitude is in the range of between about one (1) nanometer (nm) and about one-thousand (1000) nanometers (nm) [one (1) micron].

Thus, in a similar manner of usage, the 'nano' phrase, nanoscale feature(s), as used herein, refers to a feature (features) (typically, on a surface) which has (have), or is (are) associated with, at least one size dimension (e.g., length, width, height (thickness), depth, diameter, pitch), whose value or magnitude is in the range of between about one (1) nanometer (nm) and about one-thousand (1000) nanometers (nm) [one (1) micron].

Thus, in a similar manner of usage, the 'nano' phrase, nanoscale structure(s), as used herein, refers to a structure (structures) (typically, on a surface) which has (have), or is (are) associated with, at least one size dimension (e.g., length, width, height (thickness), depth, diameter, pitch), whose value or magnitude is in the range of between about one (1) nanometer (nm) and about one-thousand (1000) nanometers (nm) [one (1) micron].

As used herein, the phrase 'substrate surface', as used herein, refers to a surface of a substrate, where the term 'substrate', as used herein, refers to an underlying layer, i.e., of a surface. In general, the substrate, or underlying layer, is composed of essentially any type or kind of material or substance, or combination of materials or substances. More specifically, the substrate, or underlying layer, is composed of inorganic matter, or/and organic matter.

As used herein, the term 'replicating', as used herein, refers to copying or reproducing an object or entity. In the context of illustratively describing the method of the present invention, an example of such an object or entity is 'at least part of an array of nanoscale features' which is included on a surface of a self-assembled template. Accordingly, the term 'replicating', as used herein, refers to copying or reproducing 'at least part of an array of nanoscale features' which is included on a surface of a self-assembled template. Thus, in a similar manner of usage, the term 'replica', as used herein, refers to a copy or reproduction of an object or entity. In the context of illustratively describing the method of the present invention, an example of such an object or entity is 'at least part of an array of nanoscale features' which is included on a surface of a self-assembled template. Accordingly, the term 'replica', as used herein, refers to a copy or reproduction of 'at least part of an array of nanoscale features' which is included on a surface of a self-assembled template.

As used herein, the term 'about', as used herein, refers to ±20% of the associated value. The phrase 'room temperature', as used herein, refers to a temperature in a range of between about 15° C. and about 35° C.

Prior to the present invention it has been challenging to make very high-aspect ratio nanowires because of high molding pressure required to fill long cavities in templates. The present inventors overcame the high pressure requirement by template-free elongation of the structures of metallic glass arrays which requires very low pressure. The prior art uses templates for molding of micro- and nano-scale metallic glasses but they are expensive and disposable. The present invention resolved these issues by high-temperature nondestructive demolding that allows reuse of templates. In addition, nano-scale features are created by deformation of large features which are fabricated by using less expensive templates. Another concern with the methods used in the prior art is the fact that the fabrication of patterned surfaces and free nanostructures require two different processing steps. The present invention by its very nature intrinsically creates patterned surfaces and free nanostructures in a single step.

The instant method provides a batch fabrication which can produce thousands of metallic glass nano-wires simultaneously. The existing reusable template only works for low-aspect-ratio features whereas the present invention is suitable for fabrication of features of any aspect-ratio. All existing technologies for fabrication of metallic glass nanostructures require expensive nano-templates. In contrast, the present invention utilizes inexpensive micro-templates and creates nanostructures by subsequent template-free reduction in size. The present invention provides methods of fabrication of nano-wires and nano-tubes from any metallic glasses which have good thermoplastic forming ability.

The present invention provides a method to create nano-scale metallic glass features using micro-scale templates which are inexpensive compared to nano-scale templates. Nano-scale and macro-scale structures are being fabricated using thermoplastic molding of metallic glasses against templates; however, template-based thermoplastic molding suffers major hurdles such as: shallow features due to increase in processing pressure with increasing aspect-ratio and use of expensive disposable templates. The proposed method manipulates the flow behavior of metallic glasses to either enable complete demolding, or deform in a predictable manner. Demolding allows reuse of templates that was not possible in the past. Controlled deformation enables fabrication of nanostructures by mechanical size-reduction of larger metallic glass features. With exact control of temperature, viscosity, strain-rate, strain, anchoring, and initial feature geometry, massive fabrication of metallic glass nanostructures such as: nano-tips, nano-rods, nano-tubes, and nano-wires with controllable aspect-ratios are possible. This approach allows simultaneous fabrication of patterned metallic surfaces and metallic nanostructures aligned on templates.

Currently, no method exists to create nano-scale metallic glass features for any aspect-ratio using micro-scale templates. Most of the current designs directly use nano-scale templates to produce nano-scale metallic features; however, these template-based metallic molding experience major difficulties, which includes but is not limited to low aspect-ratio and high cost of nano-scale templates. The present invention can create nano-scale features with high-aspect-ratios (exceeding 1000) by simple mechanical elongation of micro-scale features.

The present invention provides a new method for simultaneously producing thousands of nano-scale metallic glass features using inexpensive micro-scale templates. It also provides a method for creating nano-scale features for any aspect-ratio by mechanical elongation of micro-scale features. The method used in the creation of these nano-scale metallic features will generate patterned surfaces and free standing metallic glass nanostructures simultaneously that do not require additional assemblage on templates.

Metallic glasses are emerging engineering materials because of their unique mechanical properties and polymer-like thermoplastic processing. Structures ranging from nano- to macro-scale have been fabricated by thermoplastic molding of metallic glasses against templates. However, template-based thermoplastic molding suffers major hurdles such as: shallow features due to increase in processing pressure with increasing aspect-ratio and use of expensive disposable templates. High molding pressure is a consequence of friction between the metallic glass and the templates walls. Template-free elongation of metallic glasses has been suggested as a possible solution to overcome the high pressure requirement for high-aspect-ratio structures. However, low-yield of elongation process prevents the mass production of metallic nanostructures required for applications such as catalysts, sensors, or electrodes. The use of disposable molds is related to demolding issues of metallic glasses from templates. After molding and cooling, the metallic glass structures get mechanically locked in templates and cannot be separated without sacrificing the templates. This issue amplifies for features of higher aspect-ratios due to increased contact area. The present invention overcomes these hurdles of template non-reusability and mass production of metallic glass nanostructures.

The present invention manipulates the flow behavior of metallic glasses to either enable complete demolding or deforming in a predictable manner. Demolding allows reuse of templates that was not possible in the past. Controlled deformation enables fabrication of nanostructures by mechanical size-reduction of larger metallic glass features. Therefore, nano-scale metallic glass features are created using micro-scale templates which are inexpensive compared to nano-scale templates. With exact control of temperature (viscosity), strain-rate, strain, anchoring, and initial feature geometry, the present invention can massively fabricate metallic glass nanostructures such as: nano-tips, nano-rods, nano-tubes, and nano-wires with controllable aspect-ratios. The present invention allows simultaneous fabrication of patterned metallic surfaces and metallic nanostructures aligned on templates.

One embodiment of the present invention provides a method of making metallic glass nanostructures comprising the steps of hot pressing a metallic glass into a micro-template followed by hot pulling the metallic glass composition under controlled conditions. This process is demonstrated in FIG. 1, which shows an overview of fabrication technique and examples of metallic glass nanostructures achieved through this method.

Figure 1B:
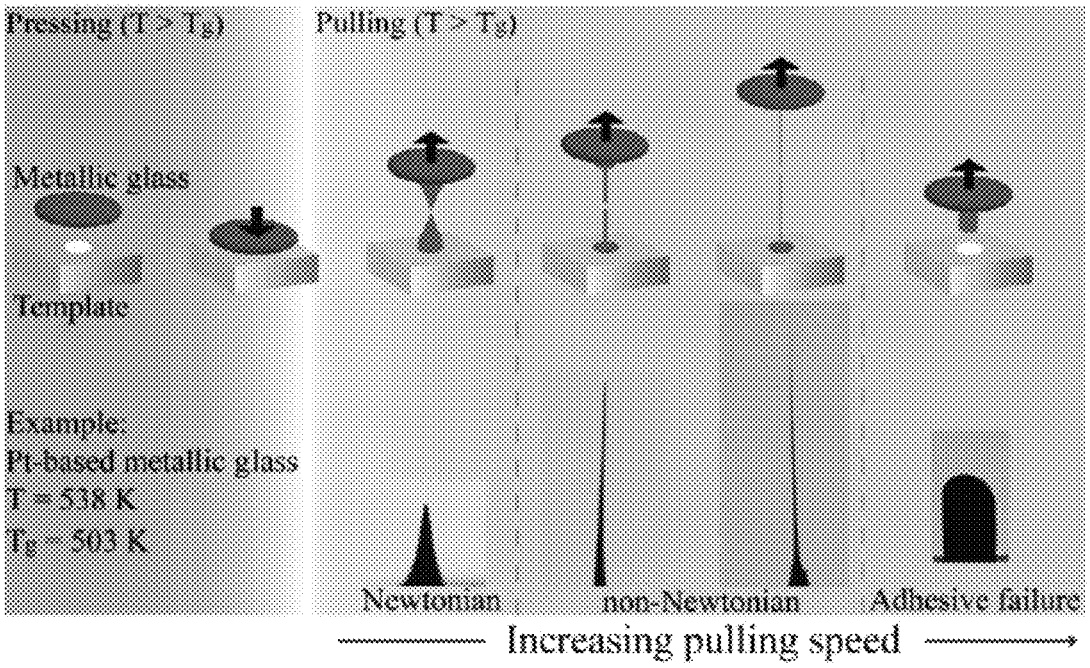

FIGS. 1A and 1B are schematic illustrations of different elongation of metallic glass supercooled liquid in different flow regimes. FIG. 1A is a schematic illustration of different flow regimes accessible through variation in strain-rate and temperature. FIG. 1B is a schematic showing the harnessing the strain-rate effects in extensional deformation of a metallic glass above $T_g$. The examples show optical micrographs of different structures formed by elongation of Pt-based metallic glass cylinder by pulling at different speeds (strain-rates). Low and intermediate pulling speeds result in elongation and rupturing of metallic glass whilst adhesive failure (complete demolding) is observed at high pulling speed.

Figure 2:
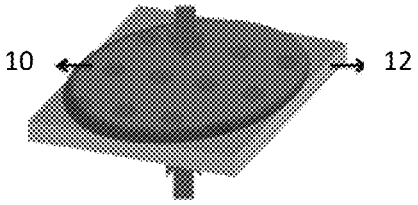
FIG. 2 shows an overview of fabrication technique for a hot metallic glass composition being pressed into a micro-template.

FIG. 2 shows a hot metallic glass composition 10 being pressed into a micro-template 12.

Figure 3A:
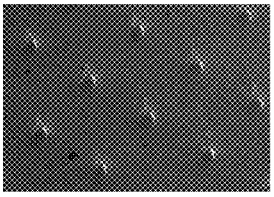
FIGS. 3A-3D show the hot metallic glass composition being hot pulled from the micro-template by adjusting the temperature, the strain-rate, and the strain to form metallic glass nano-tips both on template and metallic glass surface.
Figure 3B:
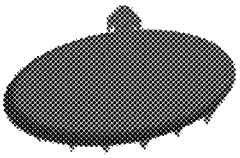
Figure 3C:
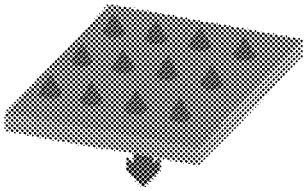
Figure 3D:
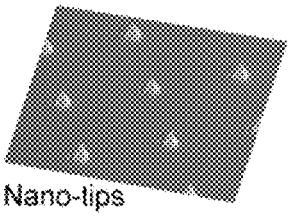

FIGS. 3A-3D show the hot metallic glass composition 10 being hot pulled from the micro-template 12 by adjusting the temperature, the strain-rate, and the strain to form metallic glass nano-tips both on template and metallic glass surface. This structure is confirmed in the SEM images. FIG. 3A (on metallic glass surface) is an SEM images of glass nano-tips, FIG. 3B is an illustration of the metallic glass surface, FIG. 3C is an illustration of the nano-tips on the template and FIG. 3D (on template) is an SEM images of glass nano-tips.

FIGS. 4A-4D show the hot metallic glass composition 10 being hot pulled from the micro-template 12 by adjusting the temperature, the strain-rate, and the strain to form metallic glass nano-rods both on template and metallic glass surface. This structure is confirmed in the SEM images. FIG. 4A (on metallic glass surface) is an SEM images of glass nano-rods, FIG. 4B is an illustration of the metallic glass surface, FIG. 4C is an illustration of the nano-rods on the template and FIG. 4D (on template) is an SEM images of glass nano-rods.

Figure 5A:
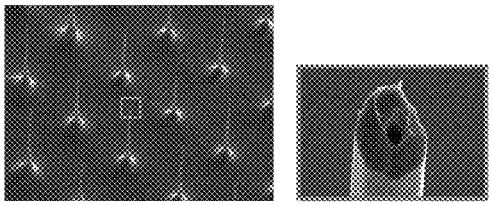
FIGS. 5A-5D show the hot metallic glass composition being hot pulled from the micro-template by adjusting the temperature, the strain-rate, and the strain to form metallic glass nano-tubes both on templates and metallic glass surface.
Figure 5B:
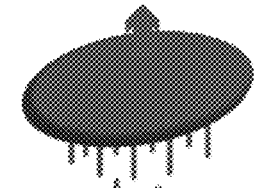
Figure 5C:
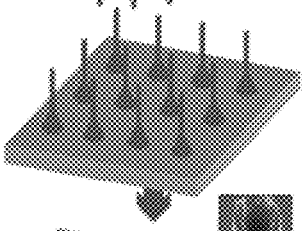
Figure 5D:
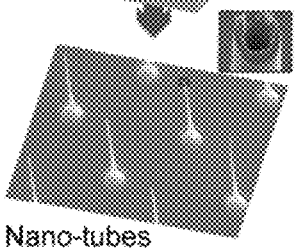

FIGS. 5A-5D show the hot metallic glass composition 10 being hot pulled from the micro-template 12 by adjusting the temperature, the strain-rate, and the strain to form metallic glass nano-tubes both on template and metallic glass surface. This structure is confirmed in the SEM images. FIG. 5A (on metallic glass surface) is an SEM images of glass nano-tubes, FIG. 5B is an illustration of the metallic glass surface, FIG. 5C is an illustration of the nano-tubes on the template and FIG. 5D (on template) is an SEM images of glass nano-tubes.

Another example of the present invention includes nanotubes that are shaped into hollow nanoneedles for permitting transport of substances there through. The hollow nanoneedles have a length of between about 10 nm and 1000000 nm, inner diameters of between about 2 nm and 100000 nm and a wall thickness of between about 2 nm and 10000 nm. However, other embodiments may have diameters (e.g., 1-100, 400-600, 600-800 and 800-1000 nm) and walls of different thickness (e.g., 1-10, 20-40, 40-60, 60-80, 80-100, 80000-100000 nm). Additionally, the microneedle may include one or more agents located in or on the surface of the microarray, within the layers of the microarray, within said one or more elongated hollow needles of the microarray or combinations thereof.

Figure 6A:
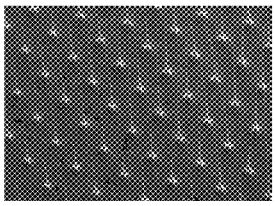
FIGS. 6A-6D show the hot metallic glass composition being hot pulled from the micro-template by adjusting the temperature, the strain-rate, and the strain to form metallic glass nano-wires both on template and metallic glass surface.
Figure 6B:
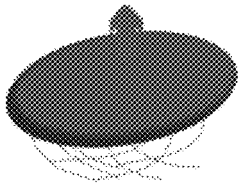
Figure 6C:
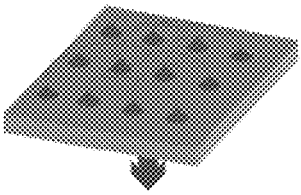
Figure 6D:
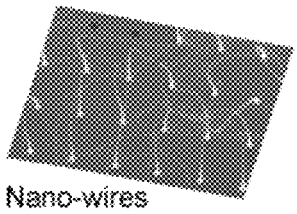

FIGS. 6A-6D show the hot metallic glass composition 10 being hot pulled from the micro-template 12 by adjusting the temperature, the strain-rate, and the strain to form metallic glass nano-wires both on template and metallic glass surface. This structure is confirmed in the SEM images. FIG. 6A (on metallic glass surface) is an SEM images of glass nano-wires, FIG. 6B is an illustration of the metallic glass surface, FIG. 6C is an illustration of the nano-wires on the template and FIG. 6D (on template) is an SEM images of glass nano-wires.

Figure 7A:
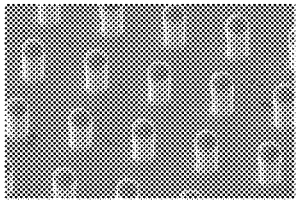
FIGS. 7A-7C show the hot metallic glass composition being hot pulled from the micro-template by adjusting the temperature, the strain-rate, and the strain to nondestructively demold the metallic glass micro-features.
Figure 7B:
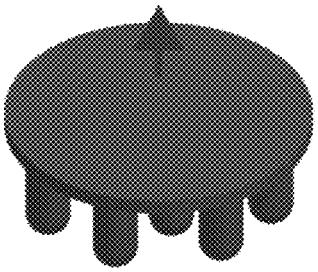
Figure 7C:
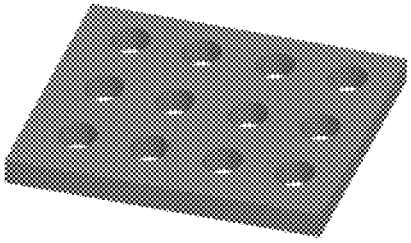

FIGS. 7A-7C show the hot metallic glass composition 10 being non-destructively demolded from the micro-template 12 by adjusting the temperature, the strain-rate, and the strain to form metallic glass microfeatures. This structure is confirmed in the SEM images. FIG. 7A (on metallic glass surface) is an SEM images of glass microfeatures, FIG. 7B is an illustration of the metallic glass surface, FIG. 7C is an illustration of the template.

Metallic glasses inherit many traits of constituent metal elements such as electrical, thermal, and optical properties but yet become malleable at temperatures well below the melting point. The viscous softening of metallic glasses has been utilized in various shaping operations such as embossing, extrusion, joining, rolling, and blow molding. In particular, embossing of metallic glasses is emerging as a novel precision metal fabrication technique due to its ability to mold micro and nanoscale structures by simple hot-pressing against a template. The method has been used in fabrication of textured metal surfaces to understand the effect of topography on wetting, cellular response, reflectance, and catalytic activity. Embossing, however, faces inherently rising flow resistance with increasing aspect-ratio or decreasing size of features. The problem can be best described by analyzing the filling kinetics of a cylindrical cavity (length=L & diameter=d) with a metallic glass during thermoplastic embossing. The required pressure (P) can be estimated by modified Hagen-Poiseuille flow equation:

$$P \approx \frac{32\eta}{t}\left(\frac{L}{d}\right)^2 - \frac{4\gamma\cos\theta}{d} + C_o\left(\frac{h}{d}\right)^2 \quad (1)$$

Where t is the embossing time, η and γ are respectively the viscosity and the surface tension of metallic glass, θ is the contact angle between the metallic glass and the template, h is the thickness of the oxide layer on metallic glass surface, and $C_o$ is a constant that depends on the mechanical properties of the oxide film (strength and Poisson's ratio). The first term arises from the template friction and scales as a square of feature aspect-ratio (L/d). The second term is the capillary pressure which renders positive for typical non-wetting conditions (θ>90°) at the template metallic glass interface. The third term is the pressure required to break the rigid oxide skin to allow the flow of metallic glass supercooled liquid. By using the typical embossing parameters ($\eta=10^7$ Pa·s and t=60 s), the first term alone approaches 500 MPa for an aspect-ratio of 10. The opposing capillary pressure and the oxide layer resistance impose additional constraints for embossing of nanoscale features. Besides these intrinsic flow barriers, the applied pressure and the resulting feature aspect-ratio are also limited by the strength of the template. Increasing aspect-ratio is crucial to enhance the performance of metal nanostructures in applications based on surface driven phenomenon such as sensing, electrochemical, light scattering, and catalytic activities. Characterization of nanoscale properties also requires at least one dimension of nanostructures to be large in order to grip and manipulate them.

The fundamental challenges in embossing of high aspect-ratio nanostructures are common to all thermoplastic materials but are exacerbated in metallic glasses due to their higher viscosity, surface tension, and rate of oxidation. Various strategies such as lowering the viscosity by processing at higher temperature or promoting wetting by surface modification, have been tested to reduce the embossing pressure. While the access to lower viscosity is certainly beneficial but the available processing time diminishes due to fast devitrification (glass to crystal transformation) kinetics at higher temperature. In addition, preventing oxidation of metallic liquids at high temperature requires an elaborate embossing set up equipped with vacuum or inert environment. The surface modification approach can only lower the capillary resistance but the dominant first term in equation (1) remains unaffected. Consequently, despite considerable efforts it is still challenging to produce high aspect-ratio nanostructures by thermoplastic embossing of metallic glasses.

The proliferation of metallic glass embossing is further hindered by inability to produce unattached nanostructures. After embossing, the nanostructures remain attached to the metallic glass substrate which hampers their characterization and applications. Separation of nanostructures from their base metallic glass is achieved through laborious focused-ion-beam (FIB) machining which severely limits the yield and the scope of embossed nanostructures. Herein, the inventors present an array drawing technique to enable fabrication of solid and hollow nanostructures (aspect-ratios>1000) from metallic glass formers of any wetting and oxidation characteristics. The resulting nanostructures are detached from the parent metallic glass and can be assembled on various substrates (silicon, quartz, metal, and polymer) or released in free form. Moreover, the nanostructures are synthesized by thermomechanical size reduction of larger features which allows the use of less expensive templates made by photolithography or simple micromachining. The inventors demonstrate that the array drawing technique is very versatile and can be easily tuned to generate assembled: nano-tips, nano-wires, nano-tubes, or nanoscale tensile specimens from diverse metallic glass formers. These nanostructures retain their amorphous structure in the as-prepared state but can be crystallized by subsequent annealing.

Pt-based ($Pt_{57.5}Cu_{17.7}Ni_{5.3}P_{22.5}$), Pd-based ($Pd_{43}Cu_{27}Ni_{10}P_{20}$), and Ni-based ($Ni_{60}Pd_{20}P_{17}B_3$) metallic glasses were prepared by using melting, fluxing, and water quenching procedures. Zr-based ($Zr_{35}Ti_{30}Cu_{8.25}Be_{26.75}$) metallic glass was acquired from LiquidMetal technologies. Aluminum and quartz templates were made by mechanical milling using carbide micro drill bits. Si templates (features with aspect-ratios of 4-5) were prepared by deep-reactive-ion-etching (DRIE). The typical thermoplastic processing temperatures for Pt-based, Pd-based, Ni-based, and Zr-based metallic glasses were 538 K ($T_g$=503 K), 633 K ($T_g$=575 K), 653 K ($T_g$=605 K), and 668 K ($T_g$=578 K), respectively. All thermoplastic experiments were conducted in air using custom-built heating platens installed on Instron 5966 mechanical tester. The templates and the metallic glass discs were mechanically secured with the lower and the upper heating plates, respectively. The metallic glass discs were first slowly (<0.5 mm/min) pressed on the templates followed by pulling at different speeds (0.5-80 mm/min) till rupture. The filling aspect-ratio of 2-3 was necessary during pressing to prevent subsequent demolding during pulling. Scanning electron microscopy (SEM) imaging was performed using Hitachi S-4300.

Metallic glass supercooled liquids exhibit a variety of flow behaviors (Newtonian, non-Newtonian, and shear-localized) depending on the temperature (viscosity) and the strain-rate (FIG. 1A). At high temperatures or low strain-rates, these metastable liquids obey Newtonian laws as the structural relaxation is fast enough to maintain the steady state. With increasing strain-rate, non-Newtonian effects set in when the rate of creation of disorder exceeds the rate at which the disorder is annihilated by structural relaxation. At even greater strain-rates, the disorder accumulates to a critical level for the onset of localized flow and the deformation proceeds through formation of shear bands. The inventors exploit this temperature and strain-rate dependent flow of metallic glass supercooled liquids to develop a novel nanofabrication technique through extensional deformation. The concept is first illustrated for a single structure (FIG. 1B) and will be later expanded into a scalable nanofabrication technique. Pt-based metallic glass was molded above its glass transition temperature ($T_g$) into a cylindrical cavity machined in an aluminum (Al) template. Subsequently, the metallic glass was pulled away from the Al template at varying speeds while maintaining the temperature above $T_g$. No-slip boundary conditions prevent complete demolding of metallic glass at low and intermediate pulling speeds. This "failure to demold" results in elongation and fracture of metallic glass cylinder at different strain-rates, and consequently in different flow regimes illustrated in FIG. 1A. At slow pulling speed (Newtonian regime), the metallic glass cylinder necks profusely before rupturing into two conical structures; one attached to the metallic glass and the other to the Al substrate (FIG. 1B). The flow becomes non-Newtonian with increasing pulling speed and the cylinder elongates extensively before final necking and rupture. The elongation is accompanied by reduction in cross-section which leads to decrease in pulling force with increasing aspect-ratio, reversing the fundamental constraint of embossing method. The final outcome after rupture is the formation of two high aspect-ratio metallic glass filaments with diameters smaller than the size of template cavity. In this non-Newtonian regime, the diameter of these filaments can be controlled by varying the pulling speed and the processing temperature. At very high pulling speed, complete demolding (adhesive failure) is observed when the cohesive strength of supercooled liquid exceeds its adhesive strength (FIG. 1B). This can enable non-destructive demolding and reusability of template which was reported in our previous work.

The sample shapes observed in our extensional studies are consistent with fracture morphologies reported in high-temperature tensile tests of metallic glasses, fiber drawing, and filament stretching of polymer melts. These previous studies have shown that Newtonian fluids neck while viscoelastic fluids can be drawn into threads of uniform diameters before break up during extensional deformation. Our drawings with a single metallic glass structure reveal three important outcomes: (1) the diameter, the aspect-ratio, and the shape of the structure can be tuned without changing the template, (2) two replicas of the structure are formed after rupture, and (3) high strain-rate pulling results in template demolding. These findings serve as guidelines for developing a scalable drawing technique for metallic glass nanostructures.

Figure 8A:
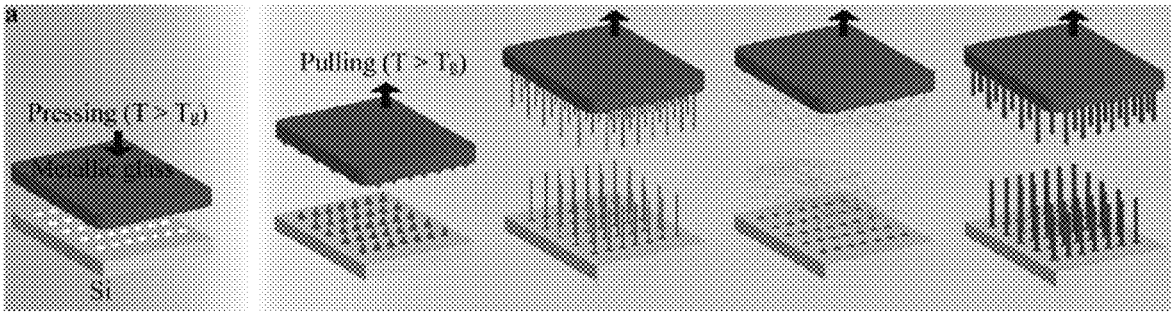
FIG. 8A is an illustration of the fabrication of arrayed nanostructures and FIG. 8B is a SEM image of the fabrication of arrayed nanostructures.
Figure 8B:
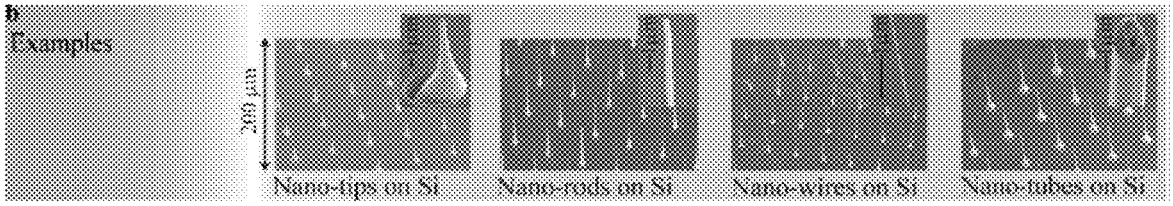

FIG. 8A is an illustration of the fabrication of arrayed nanostructures and FIG. 8B is a SEM image of the fabrication of arrayed nanostructures. FIG. 8A shows a schematic illustration of arrays drawing scheme for fabrication of metallic glass nanostructures (tips, rods, wires, and tubes) using Si templates. Two sets of nanostructures are generated by reshaping and rupturing of microfeatures: one set remains attached to the metallic glass and the other to the template. FIG. 8A shows SEM images of Pt-based metallic glass nanostructures assembled on Si templates show the feasibility of proposed method. For nanotubes, a Si template with tubular cavities was used. Photolithographically patterned Si templates were used for making arrays of metallic glass nano-tips, nano-rods, nano-wires, and nano-tubes by a combination of pressing and pulling. The SEM images show examples of Pt-based metallic glass nanostructures assembled on Si. The template cavities (diameters=20 μm and length=50-60 μm) are first filled with the metallic glass during pressing to form an array of microscale features which are subsequently downsized into nanostructures by extensional deformation under varying strain-rates. The structures neck and rupture into sharp tips under low strain-rate elongation. By increasing the strain-rate, arrays of nano-rods or nano-wires with controllable diameters and aspect-ratios can be drawn in the non-Newtonian regime. The technique is not limited to solid nanostructures as shown by the last example in FIG. 8. Metallic glass nanotubes can be produced by using donut-shaped cavities on a Si template. Similar nanostructures are unattainable by direct thermoplastic embossing of metallic glasses due to impractical pressure and template requirements. The uniformity in shapes and sizes of nanostructures shown in FIGS. 8A-8B demonstrates the feasibility of array drawing technique. The nanostructures retain their shapes after rupture due to combined effect of high viscosity and rapid cooling at free ends. The final fracture is dictated by cavitation led by the growth of surface perturbations which are stochastic in nature. However, the process can be made more controllable by interrupting the drawing process before break up followed by cooling and rupturing the metallic glass filaments below $T_g$. This leads to fracture of metallic glass filaments at similar locations resulting in formation of uniform nanostructures. Using this methodology, arrays of uniform nanostructures with diameters well below micron and controllable aspect-ratios exceeding 1000 can be formed. These nanostructures retain their glassy state as confirmed by the transmission electron microscopy (TEM) and thermal characterization.

Figure 9A:
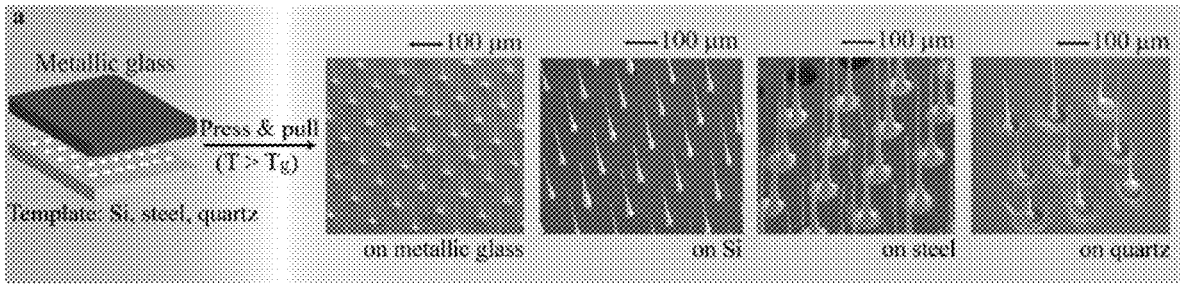
FIGS. 9A-9B show metallic glass nanostructures assembled on rigid and flexible substrates.
Figure 9B:
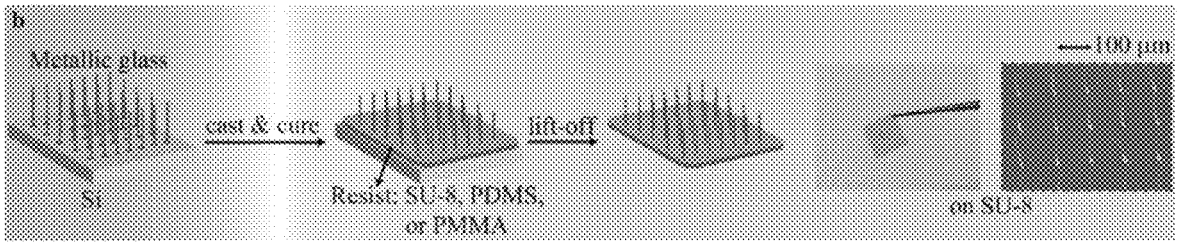

FIGS. 9A-9B show metallic glass nanostructures assembled on rigid and flexible substrates. FIG. 9A shows metallic glass nanostructures anchored to the parent substrate, Si, steel, and quartz. FIG. 9A shows the transfer of metallic glass nanostructures from Si to polymer substrates demonstrated by an example of an SU-8. After casting and curing SU-8 around nanostructures, the Si substrate was separated by etching. All SEM images are from Pt-based metallic glass. The drawing technique has the unique ability to produce nanostructures anchored to both the template and the metallic glass unlike the conventional embossing which only yields a patterned metallic glass surface. FIGS. 9A-9B show examples of nanostructures assembled on various substrates (Si, steel, quartz, and polymer) in addition to the metallic glass itself. Any material that can withstand processing temperature and pressure can be used as a template to host metallic glass nanostructures (FIG. 9A). Templates made by photolithography or simple mechanical drilling are sufficient to create metallic glass nanostructures through extensive downsizing. Even commercially available inexpensive steel mesh (pore diameter ~200 μm) can be used to produce metallic glass nano-wires. Furthermore, the metallic glass nanostructures from a Si template can be transferred to polymers by lift-off process as demonstrated by an example of SU-8 (FIG. 9B). To the best of our knowledge, this is the first time metallic glass nanostructures assembled on substrates other than itself have been demonstrated by thermoplastic processing. This is a critical step towards realizing the envisioned applications of metallic glass nanostructures which require integration of nanostructures on semiconductors and/or plastics for device fabrication.

Figure 10A:
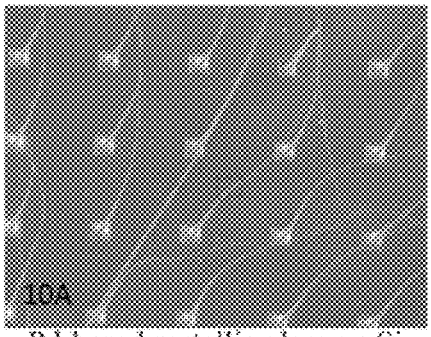
FIGS. 10A-10F show nanostructures from oxidizing metallic glass formers.
Figure 10B:
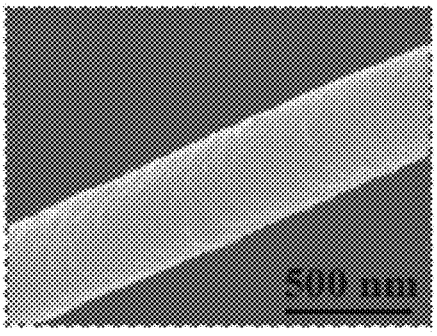
Figure 10C:
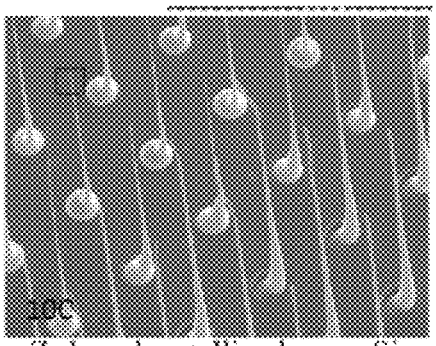
Figure 10D:
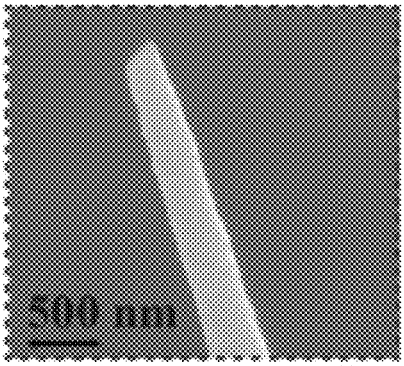
Figure 10E:
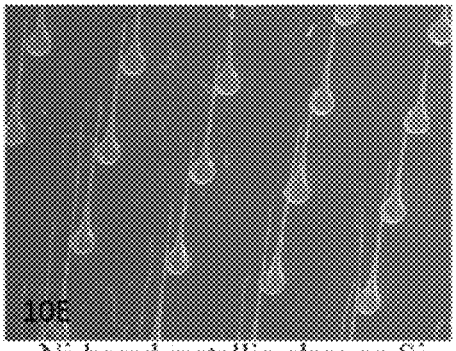
Figure 10F:
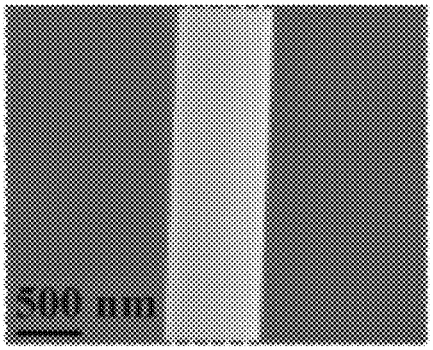

FIGS. 10A-10F show nanostructures from oxidizing metallic glass formers. FIG. 10A is a SEM image of Pd-based ($Pd_{43}Cu_{27}Ni_{10}P_{20}$) metallic glass on Si with FIG. 10B being a magnified image of a portion of FIG. 10A. FIG. 10C is a SEM image of Zr-based ($Zr_{35}Ti_{30}Cu_{8.25}Be_{26.75}$) metallic glass on Si with FIG. 10D being a magnified image of a portion of FIG. 10C. FIG. 10E is a SEM image of Ni-based ($Ni_{60}Pd_{20}P_{17}B_3$) metallic glass on Si with FIG. 10F being a magnified image of a portion of FIG. 10E. The variation in surface roughness of nanostructures originates from different oxidation kinetics of glass formers. As described in equation (1), direct embossing of nanoscale features from metallic glasses relies on suitable wetting and oxidation properties of their supercooled liquids. These requirements either limit the nanostructures to inert compositions (e.g. Pt-rich) or mandate additional processing steps such as the development of alloy specific surface modifiers. In contrast, the approach described here is applicable to metallic glasses with any interfacial properties. Nano-wires from three non-wetting and oxidation prone glass formers (Pd-based, Zr-based, and Ni-based) were fabricated without any template modification (FIGS. 10A-10F).

This is achieved by decoupling the interfacial effects from nanofabrication. The wetting and oxidation properties of metallic glass become important only for embossing of features with diameters below 500 nm (second and third terms in equation 1). Instead, the inventors use embossing for microscale features (diameters≥20 μm, aspect-ratio ~2-3) and subsequent template free elongation for nanofabrication. The microscale embossing step is essentially unaffected by the wetting and the oxidation properties of metallic glasses. The size reduction to nanoscale regime occurs during out of template stretching where the contact angle is unimportant and the uniaxial tensile stress required to break the oxide shell remains independent of feature diameter. This has been a major roadblock for nanoscale embossing of oxidizing alloys because the stress required to break the oxide layer scales inversely with the square of feature diameter. The oxidation can still affect the surface roughness during elongation (magnified SEM images in FIGS. 10A-10F) but does not prevent the formation of nanostructures unlike in embossing where the rigid oxide can clog the template cavity. The surfaces of Pd-based and Zr-based metallic glasses appear rough due to reformation of oxide skin whereas the Ni-based metallic glass retains smooth surface due to lower oxidation rate. The oxidation and surface roughness can be minimized by decreasing the processing temperature or increasing the strain-rate during elongation.

Figure 11A:
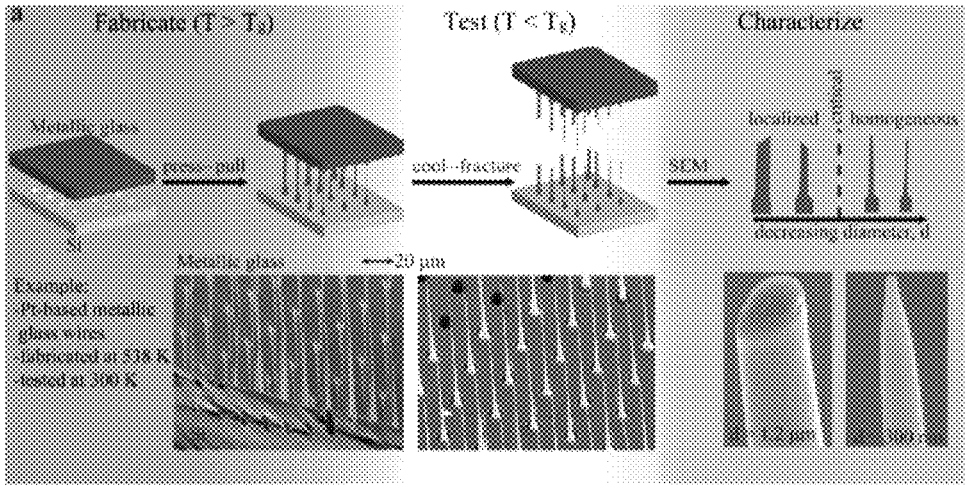
FIGS. 11A-11B are schematics of the high-throughput characterization of size-effects in deformation behavior.
Figure 11B:
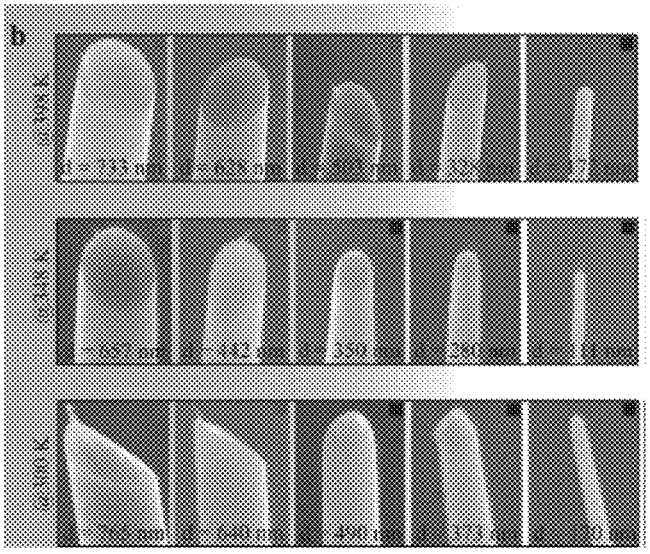
Figure 11C:
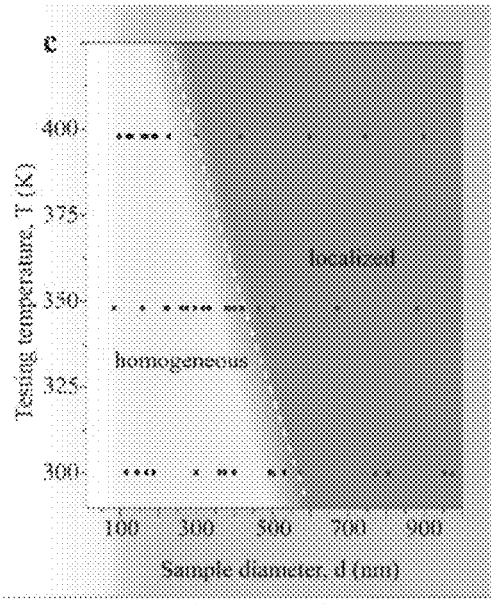
FIG. 11C shows examples of Pt-based metallic glass show that the critical sample size for localized-to-homogeneous transition decreases with increasing testing temperature.

FIGS. 11A-11C are schematics of the high-throughput characterization of size-effects in deformation behavior. FIG. 11A is a schematic illustration of parallel fabrication and testing of multiple tensile specimens with varying diameters (d) in sub-micron range. The critical sample diameter for localized-to-homogeneous flow transition can be inferred from the fracture morphology. FIG. 11B is a schematic illustration of effect of testing temperature on critical sample size is revealed by performing the tensile tests at different temperatures and then analyzing the fractured surfaces. Red and black square symbols mark localized and homogeneously deformed specimens, respectively. FIG. 11C shows examples of Pt-based metallic glass show that the critical sample size for localized-to-homogeneous transition decreases with increasing testing temperature. The inventors envisage that the fabrication technique presented here will be of interest for a wide range of fundamental studies and applications. One immediate use is expected in the field of size-effects. For example, the size dependent change in deformation mode from shear-localized (brittle) to homogeneous (ductile) flow in metallic glasses is receiving increasing attention because of its potential to prevent the catastrophic failure. However, the existence and the mechanism of this brittle-to-ductile transition have remained inconclusive due to processing artifacts (FIB irradiation, roughness) and lack of statistically reliable experimental data in nanoscale samples. Here, the inventors show that the array drawing technique can be modified into a high-throughput fabrication and testing toolbox for characterization of deformation mode in nanoscale metallic glasses (FIGS. 11A-11C). Hundreds of irradiation-free tensile specimens with varying diameters can be carved out simultaneously by thermoplastic drawing (FIG. 11A). The dog-bone shaped geometry can be achieved by stopping the drawing process before fracture. Subsequently, these samples are cooled to a desirable testing temperature below $T_g$ and fractured in tensile mode. The critical sample diameter, below which ductile behavior is observed, can be inferred from the fracture morphology[68]. Shear-localized failure results in a sharp fracture surface inclined at 45-55° to the loading axis whereas the homogeneously deformed samples exhibit necking and diffuse fracture surface (FIG. 11A). The array methodology offers three advantages over conventional fabrication and testing of individual nanoscale specimens: (1) all samples with different diameters have the same processing history, (2) samples are free of irradiation artifacts, and (3) large numbers of samples are tested to draw an unambiguous conclusion. Besides these benefits, the array testing can be performed at different temperatures and strain-rates to gain comprehensive understanding of size-effects mechanism. As shown by the example of Pt-based metallic glass tensile specimens fractured at different temperatures (FIG. 11B), a clear decrease in critical sample size with increasing temperature is observed (FIG. 11C). Similarly, the effects of cooling rate and strain-rate on the critical sample size can be measured. These studies can provide vital experimental data necessary to verify and refine the proposed hypotheses for size-effects in glassy materials. Two different mechanisms based on shear band nucleation and propagation have been proposed to explain the size dependent brittle-to-ductile transition in metallic glasses. Validation of these models requires statistically reliable experimental data which are difficult to obtain through complex fabrication and testing procedures for nanoscale specimens.

The present invention provides a versatile method to fabricate very high aspect-ratio metallic glass nanostructures assembled on various substrates. Arrays of metallic glass microfeatures are reshaped into nanostructures (solid and hollow) by controlled elongation and rupture in the supercooled liquid state. The inventors utilize Newtonian and non-Newtonian effects in metallic glass supercooled liquids to tune the shape and size of structures during extensional flow and final fracture. This approach eliminates the fundamental constraints of nanoscale embossing: rising pressure with aspect-ratio, expensive nanotemplates, limited to inert compositions, and inability to produce unsupported nanostructures. As demonstrated here, the drawing approach is capable of generating nanostructures from oxidation prone glass formers without using nanotemplates. It also creates an additional set of nanostructures detached from the metallic glass substrate after fracture. This extra set of nanostructures can be anchored on various templates or released in free form. In particular, the ability to produce metallic glass nanostructures on insulating substrates (quartz and polymer) can allow characterization of size dependent thermal and electrical properties. Such studies have been rare in the past due to difficulty in producing metallic glass nanostructures separated from the conductive base[73]. Besides scientific interests, the assembled nanostructures shown here can also enable many practical applications for metallic glasses such as electrodes, sensors, microfluidics, flexible electronics, conductive probes for atomic force microscopy, and microneedles for drug delivery. Although, the focus of this work was on metallic glasses, the parallel drawing technique can be extended to other thermoplastic materials.

Thermoplastic embossing of metallic glasses promises direct imprinting of metal nanostructures using templates. However, embossing high-aspect-ratio nanostructures faces unworkable flow resistance due to friction, and non-wetting conditions, at the template interface. Here, the inventors show that these inherent challenges of embossing can be reversed by thermoplastic drawing from templates. The flow resistance not only remains independent of wetting but also decreases with increasing feature aspect-ratio. Arrays of assembled nano-tips, nano-wires, and nano-tubes with aspect-ratios exceeding 1000 can be produced through controlled elongation and fracture of metallic glass structures. In contrast to embossing, the drawing approach generates two sets of nanostructures upon final fracture; one set remains anchored to the metallic glass substrate while the second set is assembled on the template. This method can be readily adapted for high-throughput fabrication and testing of nanoscale tensile specimens, enabling rapid screening of size-effects in mechanical behavior.

Thermoplastic replication of templates by hot-pressing of metallic glasses is well-established for fabrication of patterned surfaces. Above glass transition temperature, the metallic glasses become soft and flow into template cavities when subjected to pressure. Subsequently, the templates are cooled to room temperature and dissolved in chemicals to separate the metallic glasses. Due to thermal expansion mismatch and roughness of template cavities, the metallic glasses cannot be non-destructively detached, which limits the template use to a single operation. To overcome this issue, the present invention separates the metallic glass and the templates by controlled pulling when the metallic glass is still hot and soft. Depending on the temperature (viscosity), adhesion, and the pulling speed (strain-rate), the metallic glass structures can either demold from templates or get deformed into a rich variety of nanostructures. The shape and size of micro- and nanostructures can also be controlled by initial geometry of template features. This provides a versatile micro- and nanofabrication method for metallic glasses without resourcing to expensive nano-templates or disposable micro-templates.

Thermoplastic molding is the most economical fabrication method for small-scale metallic glass structures because machining is not suitable for such hard materials. The method works very well for micro-scale or larger structures with low aspect-ratios. Prior to the present invention, fabrication of nano-scale features with high-aspect ratios becomes difficult due to capillary pressure and template friction. The novelty of the present invention is that it can create nano-scale features with high-aspect-ratios by simple mechanical elongation of micro-scale features. This process is independent of capillary pressure and template friction because the nano-scale feature creation takes place out of templates.

Conventional nanomolding of metallic glasses produces only metallic surfaces patterned with nano-scale features. In contrast, the present invention generates patterned surfaces and free-standing metallic glass nanostructures simultaneously. In addition, the free-standing metallic glass nanostructures produced are already fixed on templates and therefore do not require any additional assemblage. The initial shape of template features provides an additional control parameter for tuning the final shape of metallic glass nanostructures. Excellent surface finish, uniform shape, and controllable aspect-ratio metallic glass nanostructures can be produced without using expensive nano-templates.

The method of the present invention can be used to form high-surface area wires for catalysts and sensors, electrodes such as neural implants, fuel cells electrodes, metal templates for nanoimprinting, inexpensive patterning of metallic glasses using reusable templates, conductive tips for scanning probe microscopy, for use in the silicon integrated circuit industry, energy industry, microneedles for drug delivery, implantable sensors industry and consumer electronics.

It is to be understood that the present invention is not limited in its application to the details of the order or sequence, and number, of steps or procedures, sub-steps or sub-procedures, of operation or implementation of the method for producing (fabricating) an array of nanoscale structures on a substrate surface, via a self-assembled template, or to the details of the equipment, chemical reagents, and materials, used for implementing the method, set forth in the following illustrative description, accompanying drawings, and examples, unless otherwise specifically stated herein. The present invention is capable of other embodiments and of being practiced or carried out in various ways. Although steps or procedures, sub-steps or sub-procedures, equipment, chemical reagents, and materials, which are equivalent or similar to those illustratively described herein can be used for practicing or testing the present invention, suitable steps or procedures, sub-steps or sub-procedures, equipment, chemical reagents, and materials, are illustratively described and exemplified herein.

It is also to be understood that all technical and scientific words, terms, or/and phrases, used herein throughout the present disclosure have either the identical or similar meaning as commonly understood by one of ordinary skill in the art to which this invention belongs, unless otherwise specifically defined or stated herein. Phraseology, terminology, and, notation, employed herein throughout the present disclosure are for the purpose of description and should not be regarded as limiting. Moreover, all technical and scientific words, terms, or/and phrases, introduced, defined, described, or/and exemplified, in the above Background section, are equally or similarly applicable in the illustrative description of the preferred embodiments, examples, and appended claims, of the present invention. Immediately following are definitions and exemplary usages of words, terms, or/and phrases, which are used throughout the illustrative description of the preferred embodiments, examples, and appended claims, of the present invention, and are especially relevant for understanding thereof. The term 'producing', and grammatical forms thereof, as used herein, are considered synonymous and equivalent to the following terms, and corresponding grammatical forms thereof: 'fabricating', 'making', 'creating', 'constructing', and 'manufacturing'.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A method of preparing metallic glass nano-structures comprising the steps of:

providing a metallic glass composition on a first surface;

heating the metallic glass composition to a temperature;

contacting a template surface to the metallic glass composition;

applying a strain by moving the template surface away from the metallic glass composition to form nano-structures on the template surface and on the first surface; and annealing the nano-structures, wherein the aspect-ratio of the nano-structures is 800 to 10,000.

2. The method of claim 1, further comprising the step of adjusting the strain and a temperature, or both, during the applying step.

3. The method of claim 1, wherein the nano-structures comprises metallic glass nano-tips, metallic glass nano-rods, metallic glass nano-tubes, metallic glass nano-needles, metallic glass nano-wires, or combinations thereof.

4. The method of claim 1, wherein the aspect-ratio of the nano-structures is greater than 1000 but less than 10,000.

5. The method of claim 1, wherein the aspect-ratio of the nano-structures is 825, 850, 875, 900, 925, 950, 975, 1000, 1025, 1050, 1075, 1100, 1125, 1150, 1175, 1200, 1225, 1250, 1275, 1300, 1325, 1350, 1375, 1400, 1425, 1450, 1475, 1500, 1550, 1600, 1650, 1700, 1800, 1900, 2000, 2100, 2200, 2300, 2400, 2500, 2600, 2700, 2800, 2900, 3000, 3500, 4000, 4500, 5000, 5500, 6000, 6500, 7000, 8000, or 9000.

6. The method of claim 1, wherein the first surface, the template surface or both are silicon, quartz, metal, and polymer.

7. The method of claim 1, wherein the metallic glass composition comprises Pt, Pd, Ni, Zn or a combination thereof.

8. The method of claim 1, wherein the metallic glass composition comprises $Pt_{57.5}Cu_{14.7}Ni_{5.3}P_{22.5}$; $Pd_{43}Cu_{27}Ni_{10}P_{20}$; $Ni_{60}Pd_{20}P_{17}B_3$; $Zr_{35}Ti_{30}Cu_{8.25}Be_{26.75}$; $Zr_{51}Ti_9Cu_{15}Be_{25}$; $Zr_{54}Ti_{11}Cu_{12.5}Be_{22.5}$; $Zr_{41.2}Ti_{13.8}Ni_{10}Cu_{12.5}Be_{22.5}$; $Zr_{46.75}Ti_{8.25}Ni_{10}Cu_{7.5}Be_{27.5}$; $Pd_{43}Ni_{10}Cu_{27}P_{20}$; $Pt_{60}Ni_{15}P_{25}$; $Ce_{68}Cu_{20}Al_{10}Nb_2$; $Au_{49}Ag_{5.5}Pd_{2.3}Cu_{26.9}Si_{16.3}$; $Zr_{36.6}Ti_{31.4}Nb_7Cu_{5.9}Be_{19.1}$; $Ti_{48}Zr_{20}V_{12}Cu_5Be_{15}$ or a combination thereof.

9. A method of preparing metallic glass nano-structures comprising the steps of:

providing a metallic glass composition on a first surface;

heating the metallic glass composition to a temperature to form an amorphous metallic glass composition;

contacting a template surface to the amorphous metallic glass composition;

applying a strain by moving the template surface away from the amorphous metallic glass composition to form amorphous nano-structures on the template surface and on the first surface; and annealing the amorphous nano-structures to form metallic glass nano-structures, wherein the aspect-ratio of the nano-structures is 800 to 10,000.

10. The method of claim 9, wherein the metallic glass nano-structures comprise $Pt_{57.5}Cu_{14.7}Ni_{5.3}P_{22.5}$; $Pd_{43}Cu_{27}Ni_{10}P_{20}$; $Ni_{60}Pd_{20}P_{17}B_3$; $Zr_{35}Ti_{30}Cu_{8.25}Be_{26.75}$; $Zr_{51}Ti_9Cu_{15}Be_{25}$; $Zr_{54}Ti_{11}Cu_{12.5}Be_{22.5}$; $Zr_{41.2}Ti_{13.8}Ni_{10}Cu_{12.5}Be_{22.5}$; $Zr_{46.75}Ti_{8.25}Ni_{10}Cu_{7.5}Be_{27.5}$; $Pd_{43}Ni_{10}Cu_{27}P_{20}$; $Pt_{60}Ni_{15}P_{25}$; $Ce_{68}Cu_{20}Al_{10}Nb_2$; $Au_{49}Ag_{5.5}Pd_{2.3}Cu_{26.9}Si_{16.3}$; $Zr_{36.6}Ti_{31.4}Nb_7Cu_{5.9}Be_{19.1}$; $Ti_{48}Zr_{20}V_{12}Cu_5Be_{15}$ or a combination thereof.

11. A method of preparing a metallic glass hollow nano-needle comprising the steps of:

providing a metallic glass composition on a first surface;

heating the metallic glass composition to a temperature to form an amorphous metallic glass composition;

contacting a template surface to the amorphous metallic glass composition;

applying a strain by moving the template surface away from the amorphous metallic glass composition to form an amorphous metallic glass hollow nano-needle on the template surface and on the first surface; and annealing the amorphous metallic glass hollow nano-needle to form a metallic glass hollow nano-needle having an aspect-ratio of 800 to 10,000.

12. The method of claim 11, wherein the metallic glass hollow nano-needle comprises $Pt_{57.5}Cu_{14.7}Ni_{5.3}P_{22.5}$; $Pd_{43}Cu_{27}Ni_{10}P_{20}$; $Ni_{60}Pd_{20}P_{17}B_3$; $Zr_{35}Ti_{30}Cu_{8.25}Be_{26.75}$; $Zr_{51}Ti_9Cu_{15}Be_{25}$; $Zr_{54}Ti_{11}Cu_{12.5}Be_{22.5}$; $Zr_{41.2}Ti_{13.8}Ni_{10}Cu_{12.5}Be_{22.5}$; $Zr_{46.75}Ti_{8.25}Ni_{10}Cu_{7.5}Be_{27.5}$; $Pd_{43}Ni_{10}Cu_{27}P_{20}$; $Pt_{60}Ni_{15}P_{25}$; $Ce_{68}Cu_{20}Al_{10}Nb_2$; $Au_{49}Ag_{5.5}Pd_{2.3}Cu_{26.9}Si_{16.3}$; $Zr_{36.6}Ti_{31.4}Nb_7Cu_{5.9}Be_{19.1}$; $Ti_{48}Zr_{20}V_{12}Cu_5Be_{15}$ or a combination thereof.

13. A method of replicating metallic glass nano-structures comprising the steps of:

providing a metallic glass composition including metallic glass nano-structures on a first surface;

heating the metallic glass composition to a temperature;

contacting a template surface to the metallic glass composition;

applying a strain by moving the template surface away from the metallic glass composition to form nano-structures on the template surface and on the first surface; and annealing the nano-structures to form metallic glass nano-structures, wherein the metallic glass nano-structures have an aspect-ratio of 800 to 10,000.

* * * * *